US010106351B2

(12) United States Patent
Lin

(10) Patent No.: US 10,106,351 B2
(45) Date of Patent: Oct. 23, 2018

(54) DELIVERY MECHANISM OF BUSINESS MACHINE

(71) Applicant: AVISION INC., Hsinchu (TW)

(72) Inventor: Chia-Ching Lin, Taichung (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/782,896

(22) Filed: Oct. 13, 2017

(65) Prior Publication Data

US 2018/0118486 A1 May 3, 2018

(30) Foreign Application Priority Data

Nov. 2, 2016 (TW) ..... 105216692 U

(51) Int. Cl.
*B65H 5/36* (2006.01)
*B65H 5/06* (2006.01)

(52) U.S. Cl.
CPC ..... *B65H 5/36* (2013.01); *B65H 5/062* (2013.01)

(58) Field of Classification Search
CPC ..... B65H 3/06; B65H 3/5207; B65H 3/54; B65H 3/66; B65H 5/36; B65H 5/062
See application file for complete search history.

(56) References Cited

U.S. PATENT DOCUMENTS 8,894,062 B1 * 11/2014 Chen ..... B65H 1/14 271/121
2003/0141650 A1 * 7/2003 Coret ..... B65H 3/042 271/34
2016/0251178 A1 * 9/2016 Kuriki ..... B65H 5/062 271/273
2016/0325949 A1 * 11/2016 Muhl ..... B65H 1/06

* cited by examiner

*Primary Examiner* — David H Bollinger

(57) ABSTRACT

A delivery mechanism of business machine including a carrier board, an assembly rack, a delivery wheel group and at least one linkage assembly is provided. The assembly rack is disposed above the carrier board. The delivery wheel group includes at least one first roller and at least one second roller. The first roller is disposed on the carrier board. The second roller is disposed on the assembly rack and leans on the first rollers. The linkage assembly includes a rotation member and a paper flattening member. The rotation member is pivotally disposed on the assembly rack. The two opposite ends of the paper flattening member are respectively disposed at the rotation member and the assembly rack, such that the paper flattening member can be displaced along a curved path.

6 Claims, 4 Drawing Sheets

DELIVERY MECHANISM OF BUSINESS MACHINE

This application claims the benefit of Taiwan application Serial No. 105216692, filed Nov. 2, 2016, the disclosure of which is incorporated by reference herein in its entirety.

TECHNICAL FIELD

The disclosure relates in general to a delivery mechanism, and more particularly to a delivery mechanism of business machine.

BACKGROUND

In the past, data and documents are stored in the form of physical data and documents. However, in the digital age, data and documents are firstly digitalized and then are stored in the form of digital data and documents, hence saving the physical space of storage.

The data and documents can be digitalized by scanning physical data and documents using a scanner to obtain digitalized data and documents. Although the automatic feeding and ejecting functions of an automatic scanner greatly increase the efficiency for scanning physical and documents, the problem of paper jam still may occur, particularly when the to-be-scanned data and documents are wrinkled, warped or broken. According to the generally-known practice of resolving the above problem, a paper flattening mechanism is disposed inside the automatic scanner to avoid the to-be-scanned data and documents being wrinkled or warped, and therefore reduce the probability of paper jam.

According to the generally-known practice, one end of the paper flattening mechanism is pivotally disposed on the housing, and the other end of the paper flattening mechanism is used to press the to-be-scanned documents. Since the paper flattening mechanism disposed in this way may easily press the to-be-scanned document by points or nearly points, the paper flattening effect will deteriorate. Therefore, how to increase the paper flattening effect of the paper flattening mechanism and reduce the probability of paper jam has become a prominent task to the industries.

SUMMARY

The disclosure is directed to a delivery mechanism of business machine capable of increasing the paper flattening effect of the paper flattening mechanism and reducing the probability of paper jam.

According to one embodiment, a delivery mechanism of business machine including a carrier board, an assembly rack, a delivery wheel group and at least one linkage assembly is provided. The assembly rack is disposed above the carrier board. The delivery wheel group includes at least one first roller and at least one second roller. The first roller is disposed on the carrier board. The second roller is disposed on the assembly rack and leans on the first rollers. The linkage assembly includes a rotation member and a paper flattening member. The rotation member is pivotally disposed on the assembly rack. The two opposite ends of the paper flattening member are respectively disposed at the rotation member and the assembly rack, such that the paper flattening member is allowed to be displaced along a curved path.

According to the delivery mechanism of business machine of the above embodiment, the paper flattening member, under the guidance of the rotation member and the curved groove, will be obliquely displaced with respect to the carrier board. Therefore, regardless of the thickness of the flexible object, the paper flattening surface of the paper flattening member almost presses the flexible object by the entire surface, such that the linkage assembly is allowed to generate better paper flattening effect on the flexible object to avoid the problem of paper feed.

The above and other aspects of the invention will become better understood with regard to the following detailed description of the preferred but non-limiting embodiment(s). The following description is made with reference to the accompanying drawings.

DETAILED DESCRIPTION

Figure 1:
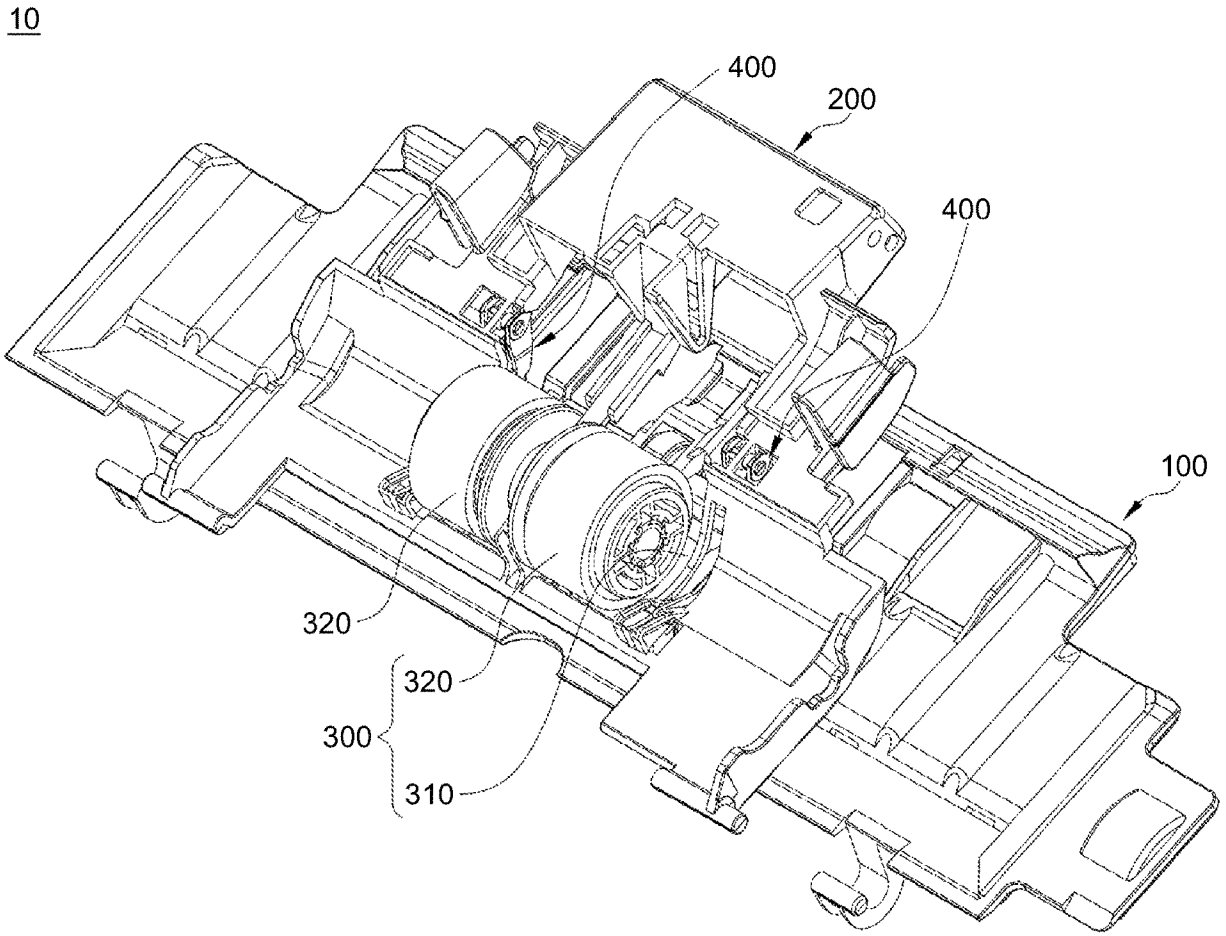
FIG. 1 is a 3D schematic diagram of a delivery mechanism of business machine according to a first embodiment of the invention.
Figure 2:
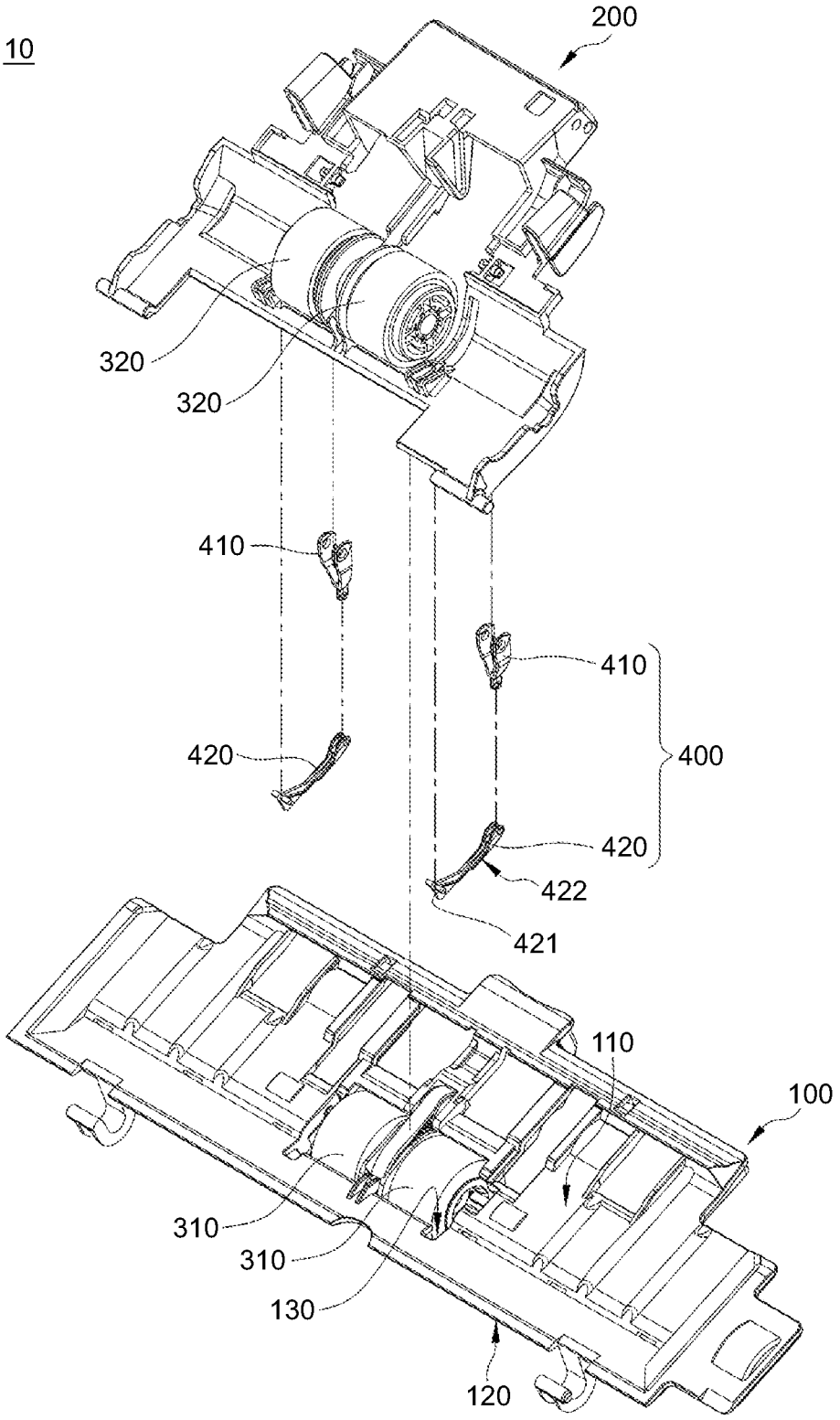
FIG. 2 is an explosion diagram of FIG. 1.
Figure 3:
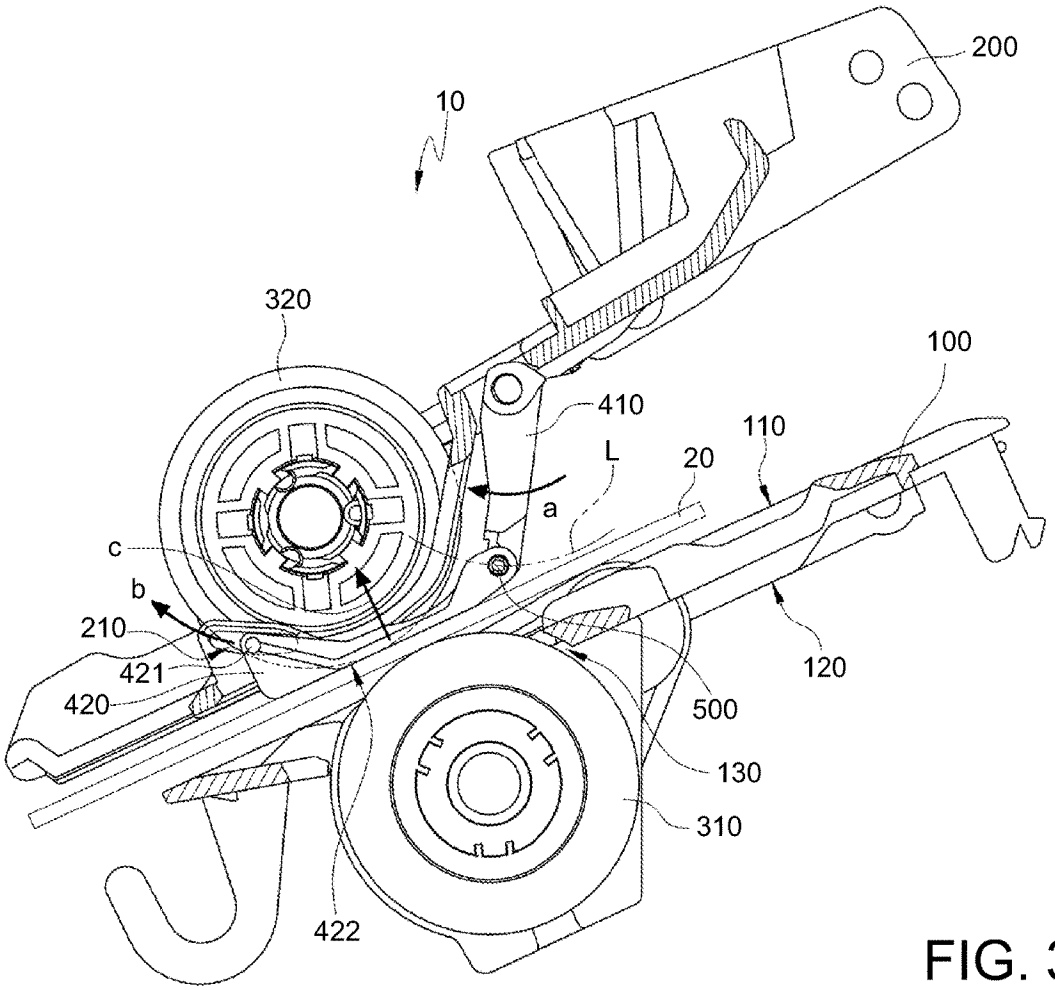
FIG. 3 is a cross-sectional view of the delivery mechanism of business machine of FIG. 1 in conjunction with a flexible object.

Refer to FIG. 1 to FIG. 3. FIG. 1 is a 3D schematic diagram of a delivery mechanism of business machine according to a first embodiment of the invention. FIG. 2 is an explosion diagram of FIG. 1. FIG. 3 is a cross-sectional view of the delivery mechanism of business machine of FIG. 1 in conjunction with a flexible object.

The delivery mechanism of business machine 100 of the present embodiment is, for example, disposed within the business machine (not illustrated) for delivering a flexible object 20 (as indicated in FIG. 3). The business machine can be realized by such as a photocopier, a printer, a scanner, or a multi-function machine integrating the functions of photocopier, scanner and printer. The flexible object is a plate and can be bent and deformed according to the transmission path. When the flexible object is delivered by the delivery mechanism, the flexible object can be deformed and bent according to the transmission path. The flexible object can be realized by such as a plate, a film or a piece of paper.

The delivery mechanism of business machine 10 includes a carrier board 100, an assembly rack 200, a delivery wheel group 300, and two linkage assemblies 400.

The carrier board 100 has a carrying surface 110, a back surface 120 and a slot 130. The carrying surface 110 carries the flexible object 20. The back surface 120 is opposite to the carrying surface 110. The slot 130 passes through the carrying surface 110 and the back surface 120.

The assembly rack 200 is disposed above the carrier board 100. It should be noted: the assembly rack 200 can be disposed above the carrier board 100 through the carrier board 100 or other fixing casing of the business machine (not illustrated), but the invention is not limited thereto.

The delivery wheel group 300 includes two first rollers 310 and two second rollers 320. Both of the two first rollers 310 pass through the slot 130, and can be rotatably disposed on the carrier board 100. The second rollers 320 are disposed on the assembly rack 200. The second rollers 320 and lean on the first rollers 310. When the second rollers 320 are realized by passive rollers, the second rollers 320 can be driven by the first rollers 310 and have a rotation direction inverse to that of the first rollers 310. Furthermore, the second rollers 320 can be driven by a drive element (not illustrated), and have a rotation direction identical to that of the first rollers 310.

In the present embodiment, the quantity of the first rollers 310 and that of the second rollers 320 both are exemplified by two, but the invention is not limited thereto. In other embodiments, the quantity of the first roller 310 and that of the second roller 320 both are exemplified by one.

The delivery wheel group 300 is interposed between two linkage assemblies 400. Each linkage assembly 400 includes a rotation member 410 and a paper flattening member 420. The rotation member 410 is pivotally disposed on the assembly rack 200. Two opposite ends of the paper flattening member 420 are disposed at the rotation member 410 and the assembly rack 200, respectively. Specifically, the assembly rack 200 has a curved groove 210. One end of the paper flattening member 420 has a slider 421 slidably disposed in the curved groove 210. The other end of the paper flattening member 420 is pivotally disposed on the rotation member 410 by a pivot 500. Thus, when the rotation member 410 rotates with respect to the assembly rack 200, the rotation member 410 will displace the paper flattening member 420 horizontally along a curved path. Besides, the paper flattening member 420 has a paper flattening surface 422. During the displacement process of the paper flattening member 420, the paper flattening surface 422 face and is parallel to the carrying surface 110.

In the present embodiment, the pivot 500 is displaced along a curve L with respect to the assembly rack 200. Furthermore, since the distance between the slider 421 and the pivot 500 is different from the distance between the slider 421 and the carrier board 100, the curvature of the curve L is different from that of the curved groove 210, and the paper flattening member 420 is displaced horizontally along the curved path. However, the invention is not limited thereto. In other embodiments, if the distance between the slider 421 and the pivot 500 is the same as that between the slider 421 and the carrier board 100, the curve L will have the same curvature as that of the curved groove 210.

In the present embodiment, the quantity of the linkage assembly 400 is exemplified by two, but the invention is not limited thereto. In other embodiments, the quantity of the linkage assembly 400 can be singular.

Figure 4:
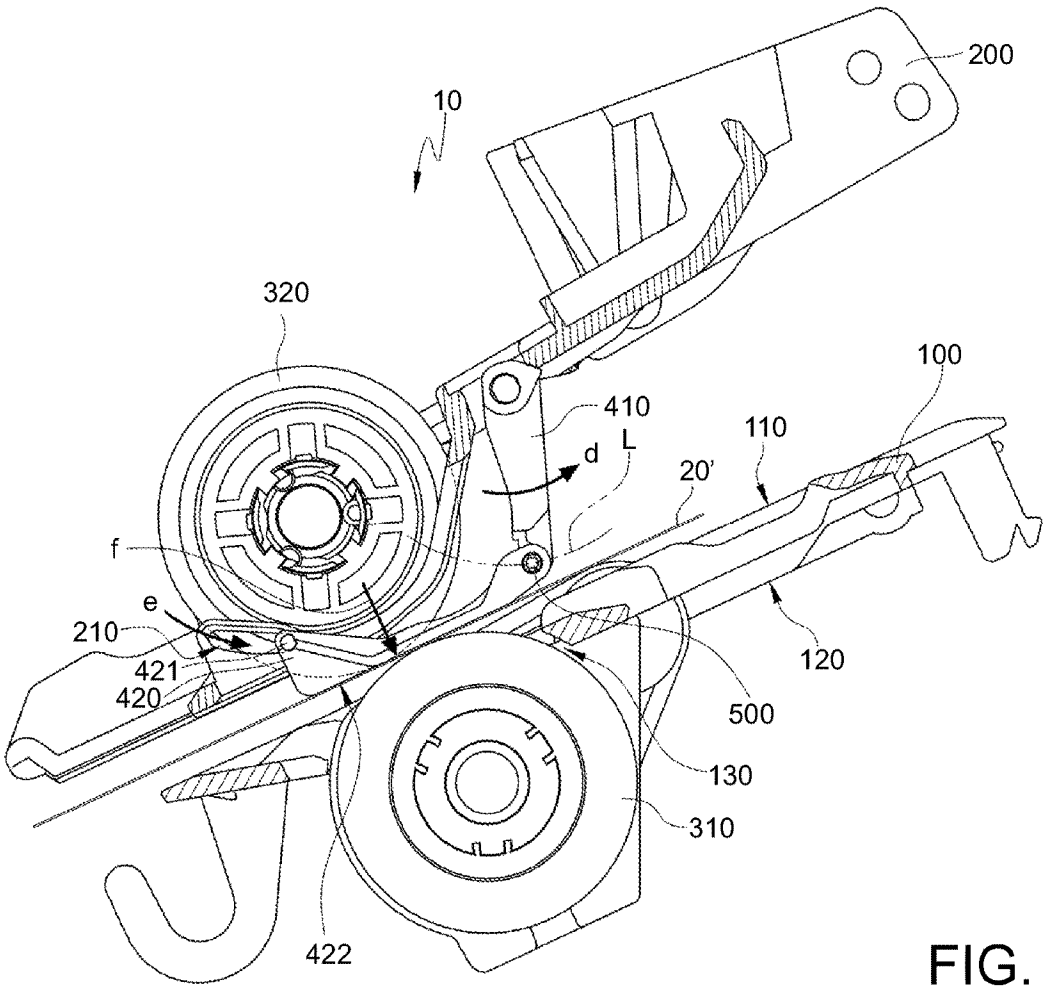
FIG. 4 is a cross-sectional view of the delivery mechanism of business machine of FIG. 1 in conjunction with another flexible object.

Refer to FIG. 3 and FIG. 4. FIG. 4 is a cross-sectional view of the delivery mechanism of business machine of FIG. 1 in conjunction with another flexible object.

As indicated in FIG. 3, when the flexible object 20 passes between the first rollers 310 and the second rollers 320, the flexible object 20 will press the paper flattening member 420, and make the rotation member 410 rotate from the carrier board 100 (the direction of the arrow a), and the slider 421 will move away from the carrier board 100 along the curved groove 210 (the direction of the arrow b). Under the guidance of the rotation member 410 and the curved groove 210, the paper flattening member 420 will move away from the carrier board 100 (the direction of the arrow f) but will keep pressing the flexible object 20. It should be noted: the paper flattening member 422 almost presses the flexible object 20 by the entire surface, such that the flexible object 20 is flat when passing the first rollers 310 and the second rollers 320. That is, the paper flattening member 420 being displaced along the curved path helps to avoid the flexible object 20 being wrinkled or warped, and therefore reduce the probability of the delivery mechanism 10 having paper jam.

As indicated in FIG. 4, the delivery mechanism 20 is loaded with a flexible object 20' thinner than the flexible object 20. When the flexible object 20' passes between the first rollers 310 and the second rollers 320, the flexible object 20 still presses the paper flattening member 420. In comparison to the situation when the delivery mechanism 20 is loaded with the flexible object 20, the paper flattening member 420 is lifted to a lesser degree (farther away from the carrier board 100). That is, in comparison to the situation when the delivery mechanism 20 is loaded with the flexible object 20, the rotation member 410 will rotate towards the carrier board 100 (the direction of the arrow d), and the slider 421 will move towards the carrier board 100 along the curved groove 210 (the direction of the arrow e). Moreover, under the guidance of the rotation member 410 and the curved groove 210, the paper flattening member 420 will move towards the carrier board 100 (the direction of the arrow f), but will keep pressing the flexible object 20. It should be noted: the paper flattening surface 422 almost presses the flexible object 20' by the entire surface, such that the flexible object 20' is flat when passing the first rollers 310 and the second rollers 320. That is, the paper flattening member 420 being displaced along the curved path helps to avoid the flexible object 20' being wrinkled or warped, and therefore reduce the probability of the delivery mechanism 10 having paper jam.

As indicated in FIG. 3 and FIG. 4, no matter the delivery mechanism 10 is delivering the flexible object 20 having a larger thickness or the flexible object 20' having a smaller thickness, the paper flattening surface 422 presses the flexible object 20 or 20' almost by the entire surface to increase the paper flattening effect of the linkage assembly 400.

According to the delivery mechanism of business machine disclosed in above embodiments, the paper flattening member, under the guidance of the rotation member and the curved groove, will be displaced obliquely with respect to the carrier board. Therefore, regardless of the thickness of the flexible object, the paper flattening surface of the paper flattening member almost presses the flexible object by the entire surface to increase the paper flattening effect of the linkage assembly and avoid the problem of paper feed.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A delivery mechanism of business machine, comprising:

a carrier board;

an assembly rack disposed above the carrier board;

a delivery wheel group, comprising at least one first roller and at least one second roller, wherein the first roller is disposed on the carrier board, and the second roller is disposed on the assembly rack and leans on the first roller; and at least one linkage assembly, comprising a rotation member and a paper flattening member, wherein the rotation member is pivotally disposed on the assembly rack, and two opposite ends of the paper flattening member are respectively disposed at the rotation member and the assembly rack, such that the paper flattening member is allowed to be displaced along a curved path.

2. The delivery mechanism of business machine according to claim 1, wherein the assembly rack has a curved groove, and the paper flattening member has a slider slidably disposed in the curved groove.

3. The delivery mechanism of business machine according to claim 2, wherein the paper flattening member is pivotally disposed on the rotation member by a pivot, which can be displaced with respect to the assembly rack along a curve whose curvature is equivalent to that of the curved groove.

4. The delivery mechanism of business machine according to claim 1, wherein the carrier board has a carrying surface, the paper flattening member has a paper flattening surface, and during the displacement process of the paper flattening member, the paper flattening surface faces and is parallel to the carrying surface.

5. The delivery mechanism of business machine according to claim 1, wherein the rotation direction of the second rollers is identical or inverse to that of the first rollers.

6. The delivery mechanism of business machine according to claim 1, wherein the quantity of the at least one linkage assembly is exemplified by two, and the delivery wheel group is interposed between the two linkage assemblies.

* * * * *